US008459069B2

(12) United States Patent
Garner

(10) Patent No.: US 8,459,069 B2
(45) Date of Patent: Jun. 11, 2013

(54) MULTI-LOCK SECURITY DEVICE AND DETACHING DEVICE FOR USE THEREWITH

(76) Inventor: Glen Walter Garner, Toronto (CA)

( * ) Notice: Subject to any disclaimer, the term of this patent is extended or adjusted under 35 U.S.C. 154(b) by 0 days.

(21) Appl. No.: 13/291,902

(22) Filed: Nov. 8, 2011

(65) Prior Publication Data

US 2012/0111071 A1 May 10, 2012

Related U.S. Application Data

(62) Division of application No. 11/987,558, filed on Nov. 30, 2007, now Pat. No. 8,051,686.

(51) Int. Cl.
*E05B 65/00* (2006.01)

(52) U.S. Cl.
USPC ..... 70/57.1; 24/704.1; 340/572.1

(58) Field of Classification Search
USPC ..... 70/57.1, 276, 279.1; 24/704.1, 704.2; 340/568.1, 571, 572.1, 572.8, 572.9
See application file for complete search history.

(56) References Cited

U.S. PATENT DOCUMENTS

| | | | | | |
|---|---|---|---|---|---|
| 3,911,534 | A | | 10/1975 | Martens et al. | |
| 3,942,829 | A | | 3/1976 | Humble et al. | |
| 4,254,868 | A | | 3/1981 | Humble et al. | |
| 4,299,870 | A | | 11/1981 | Humble | |
| 4,339,853 | A | * | 7/1982 | Lipschitz | 70/57.1 |
| D274,796 | S | | 7/1984 | Humble | |
| 4,502,717 | A | * | 3/1985 | Close | 70/57.1 |
| 4,523,356 | A | | 6/1985 | Charlot | |
| 4,531,264 | A | | 7/1985 | Minasy | |
| 4,590,461 | A | | 5/1986 | Cooper | |
| 4,774,503 | A | | 9/1988 | Bussard | |
| 4,944,075 | A | | 7/1990 | Hogan | |
| 4,987,754 | A | * | 1/1991 | Minasy et al. | 70/57.1 |
| 4,993,245 | A | | 2/1991 | Ott | |
| 5,069,047 | A | * | 12/1991 | Lynch et al. | 70/57.1 |
| 5,077,872 | A | | 1/1992 | Guthammar | |
| 5,088,165 | A | * | 2/1992 | Minasy et al. | 70/57.1 |
| D343,368 | S | | 1/1994 | Witzky et al. | |
| D348,189 | S | | 6/1994 | Witzky et al. | |
| 5,367,289 | A | | 11/1994 | Baro et al. | |
| D356,476 | S | | 3/1995 | Witzky et al. | |
| 5,426,419 | A | | 6/1995 | Nguyen et al. | |
| 5,528,914 | A | | 6/1996 | Nguyen et al. | |
| 5,535,606 | A | | 7/1996 | Nguyen et al. | |
| 5,680,681 | A | | 10/1997 | Fuss | |
| 5,955,951 | A | | 9/1999 | Wischerop et al. | |
| 6,023,951 | A | | 2/2000 | Maurer et al. | |
| 6,255,950 | B1 | | 7/2001 | Nguyen | |
| 6,449,991 | B1 | | 9/2002 | Hogan | |
| 7,073,236 | B2 | | 7/2006 | Xue et al. | |

(Continued)

*Primary Examiner* — Christopher Boswell
(74) *Attorney, Agent, or Firm* — Hill & Scumacher

(57) ABSTRACT

A security device for use in association with a security pin includes a tag body, at least one sensor, a spring lock and a magnetic lock. The tag body has a body aperture formed therein adapted to receive the security pin. The spring lock and magnetic lock are situated within the tag body. The spring lock has a spring lock aperture formed therein and the magnetic lock has a magnetic lock aperture formed therein each in registration with the body aperture. The spring lock and the magnetic lock are each adapted to engage the security pin when in an engaged position and release the security pin when in a released position. The spring lock and the magnetic lock need to both be in the released position to successfully remove the security pin form the security device.

6 Claims, 10 Drawing Sheets

U.S. PATENT DOCUMENTS

| | | | | |
|---|---|---|---|---|
| 7,084,766 | B2 | 8/2006 | Sayegh et al. | |
| 7,347,068 | B2 | 3/2008 | Seidel | |
| 7,400,254 | B2 | 7/2008 | Yang et al. | |
| 7,474,222 | B2 | 1/2009 | Yang et al. | |
| 2004/0159131 | A1 * | 8/2004 | Huehner | 70/57.1 |
| 2006/0097872 | A1 | 5/2006 | Ho | |

* cited by examiner

MULTI-LOCK SECURITY DEVICE AND DETACHING DEVICE FOR USE THEREWITH

CROSS REFERENCE TO RELATED UNITED STATES PATENT APPLICATION

This patent application is a Divisional application of U.S. patent application Ser. No. 11/987,558, filed on Nov. 30, 2007, entitled "MULTI-LOCK SECURITY DEVICE AND DETACHING DEVICE FOR USE THEREWITH" which is incorporated herein by reference in its entirety.

FIELD OF THE INVENTION

This invention relates to security devices and in particular security devices that use at least two locks.

BACKGROUND OF THE INVENTION

The use of security devices in retail establishments has become wide spread over the last decades. During the last forty years there have been three main methods to secure a tag on a garment with a pin. One major company Sensomatic, now owned by Tyco introduced the Tinnerman™ lock in the 70s, and then followed by a later locking mechanism for their Supertag™. Both these designs have proven to be very successful for the retailers mainly for apparel fashion goods. The third major lock in this field of security is a ball lock. Although, there are many variations in design, the general concept is that a magnet is used to pull the spring and the attached plunger to reduce pressure on the ball bearings thereby releasing the pin. The ball lock type lock has been applied to other products such as video cases and DVD cases for the security of media and software.

There are a number of difficulties associated with these types of security systems. Specifically, 99% of all security devices used in the market can be released with three different styles of detachers. Therefore a typical shopping mall in the USA may have a wide variety of security devices but they can be simply removed with one of three detachers and most probably just one. Accordingly, for someone intent on stealing the use of one universal detacher makes the theft considerably easier.

SUMMARY OF THE INVENTION

The present invention is a security device which includes at least multi-locks and at least one pin. Each lock is adapted to releasably receive one pin. At least one pin and the at least two locks are attached together.

A security device for use in association with a security pin includes a tag body, a spring lock and a magnetic lock. The tag body has a body aperture formed therein adapted to receive the security pin. The spring lock is situated within the tag body and has a spring lock aperture formed therein in registration with the body aperture. The spring lock is adapted to engage the security pin when in an engaged position and release the security pin when in a released position. The magnetic lock is within the tag body and has a magnetic lock aperture. The magnetic lock is adapted to engage the security pin when in an engaged position and to release the security pin when in a released position. The spring lock and the magnetic lock need to both be in the released position to successfully remove the security pin from the security device. According to one embodiment, the spring lock includes one of a generally rectangular shaped spring and a generally cross shaped spring.

In another aspect of the invention there is provided a detacher assembly for use in association with security devices having a spring lock having and engaged position and a released position and a magnetic lock having an engaged position and a released position and a pin adapted to engage the spring lock and the magnetic lock. The detaching device includes a spring lock detacher and a magnetic lock detacher. The spring lock detacher is adapted to move the spring lock from the engaged position to the released position. The magnetic lock detacher is adapted to move the magnetic lock from the engaged position to the released position whereby the spring lock and the magnetic lock are in the released position at the same time.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
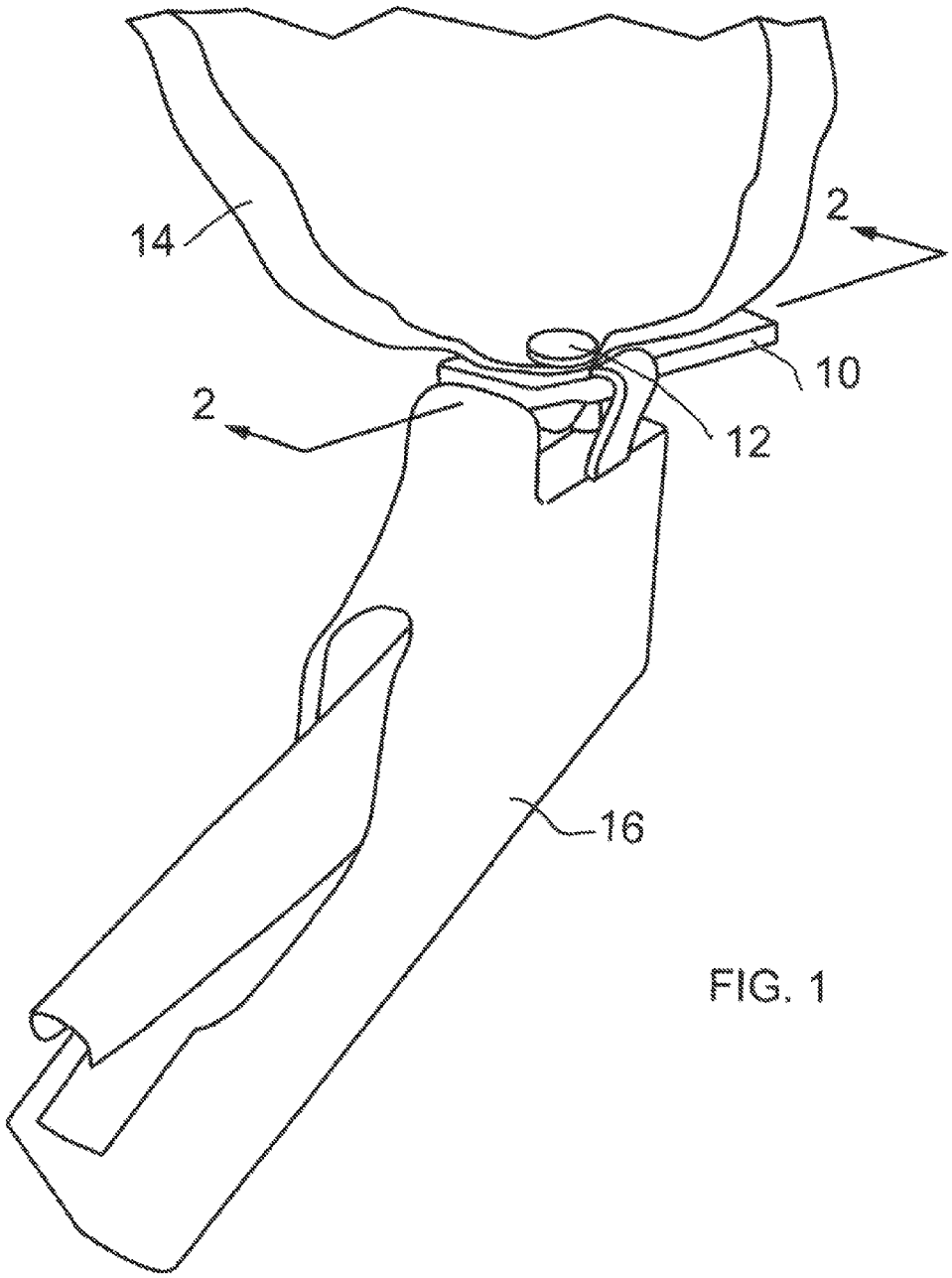
FIG. 1 is a perspective view of a multi-lock security device attached to a product with one pin and a detaching device all constructed in accordance with the present invention.

Referring to FIG. 1, the multi-lock security device 10 and pin 12 of the present invention is attached to a product 14. A detaching device 16 is shown engaging the security device 10.

Figure 4:
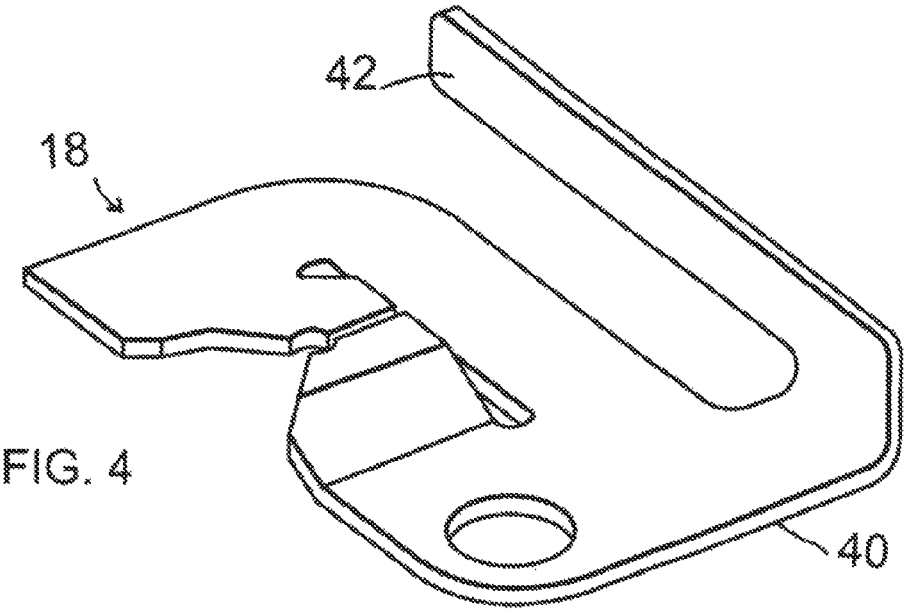
FIG. 4 is a perspective view of a spring lock with a release arm for use in the multi-lock security device of the present invention.
Figure 5:
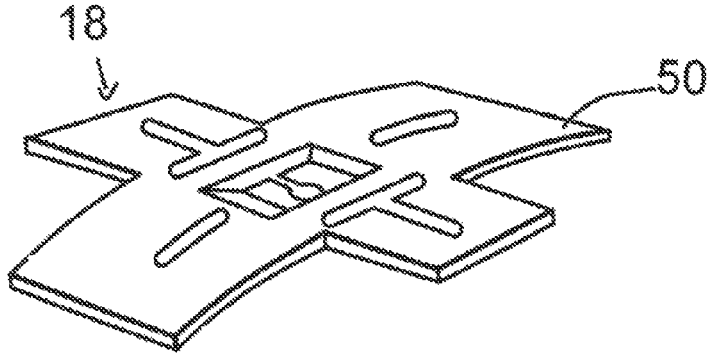
FIG. 5 is a perspective view of a cross shaped spring lock for use in the multi-lock security device of the present invention.
Figure 6:
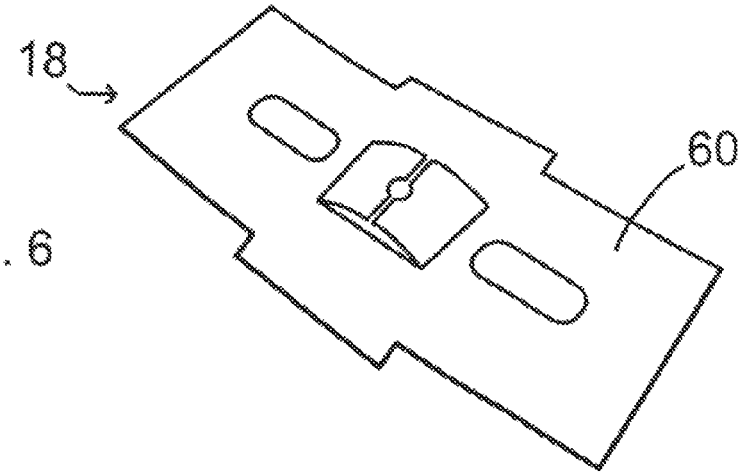
FIG. 6 is a perspective view of a generally elongate spring lock for use in the multi-lock security device of the present invention.

Security device 10 includes a spring lock 18 and a magnetic lock 20. In addition, preferably the security device includes a sensor 94 or ink vile 96. The security device 10 may include different types of spring locks 18 and magnetic locks 20. Examples of different spring locks are shown in FIGS. 4, 5 and 6. Examples of different magnetic locks are shown in FIGS. 2 and 3, 7 and 8, and 9 and 10.

Figure 2:
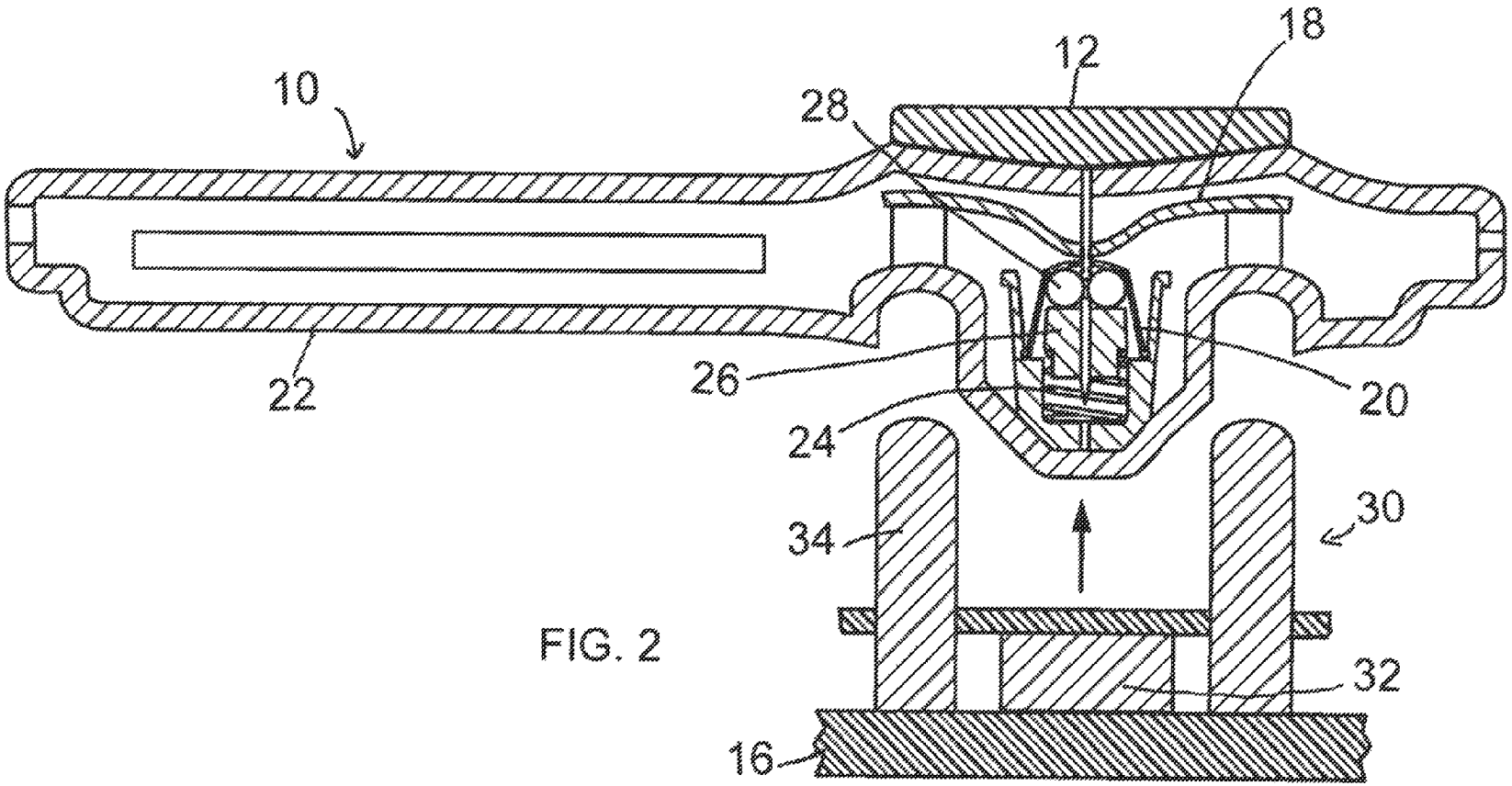
FIG. 2 is a sectional view of the multi-lock security device and pin and detaching device as taken along line 2-2 of FIG. 1, wherein the magnetic lock is a ball bearing type lock and showing the security device in the lock position.
Figure 3:
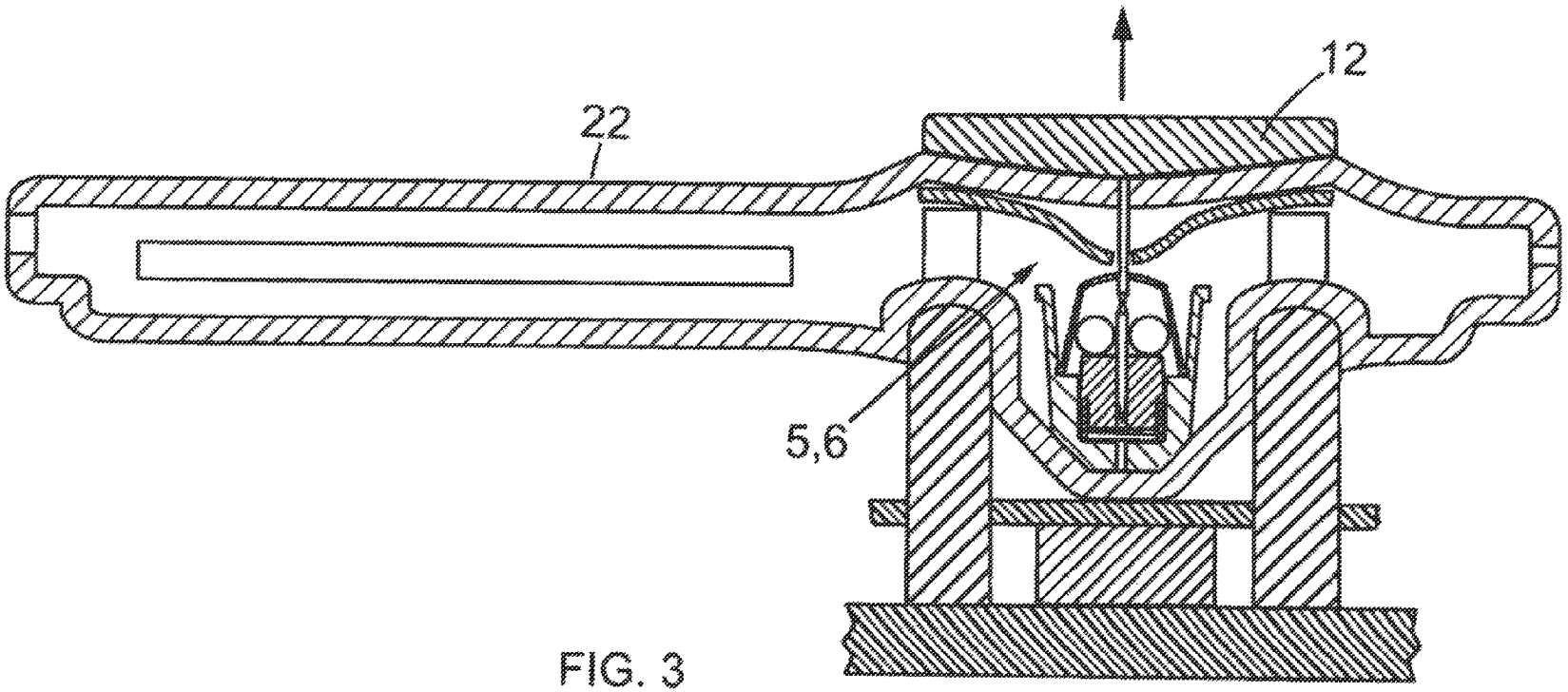
FIG. 3 is a sectional view of the multi-lock security device and pin and detaching device as shown in FIG. 2 but showing the security device in the released position.

Referring to FIGS. 2 and 3, the security device includes a spring lock 18 and a magnetic lock 20. The spring lock 18 and the magnetic lock 20 are arranged such that they engage the same pin 12. The spring lock 18 and the magnetic lock 20 have an engaged position shown in FIG. 2 and a released position shown in FIG. 3. To successfully remove the pin 12 form the security device 10 both of the spring lock 18 and the magnetic lock 20 have to be in the released position at the same time. Accordingly, the detaching device 16 has to include a means to detach the spring lock 18 and the magnetic lock 20 such that each lock is in the released position at the same time. Accordingly, a detaching device that works for only one type of lock would not release the security device 10 from the product 14.

The security device 10 has a housing 22 that is shaped so that the spring lock 18 and the magnetic lock 20 are in registration with each other. The magnetic lock 20 shown in FIGS. 2 and 3 includes a spring 24, a piston 26 and a plurality of ball bearings 28. There are a number of ball bearing locks found in the prior art and any of these locks would work in association with the present invention. An example of such a ball bearing lock is found in U.S. Pat. No. 3,911,534 issued to Martens et al. on Oct. 14, 1975 which is incorporated herein by reference. However, this is only one such example. It will be appreciated by those skilled in the art that other ball berating locks may also be used.

The detaching device 16 includes a means 30 of releasing the spring lock 18 and a magnet 32 to release the magnetic lock 20. The means of releasing the spring lock 30 includes posts 34 that bear against the housing 22 and transfer a force to the spring lock 18. The magnet 32 is positioned such that the magnet lock 20 is moved to the released position shown in FIG. 3 when the spring lock 18 is in the released position.

FIGS. 4, 5 and 6 show examples of spring locks 18 that may be used in the multi-lock security device 10 of the present invention. However, it will be appreciated by those skilled in the art that these spring locks are by way of example only and that other spring locks may also be used. An example of a spring lock 18 is shown generally in FIG. 4 at 40. Spring lock 40 is disclosed in U.S. Pat. No. 5,425,419 issued to Nguyen et al. on Jun. 20, 1995 which is incorporated herein by reference.

Figure 12:
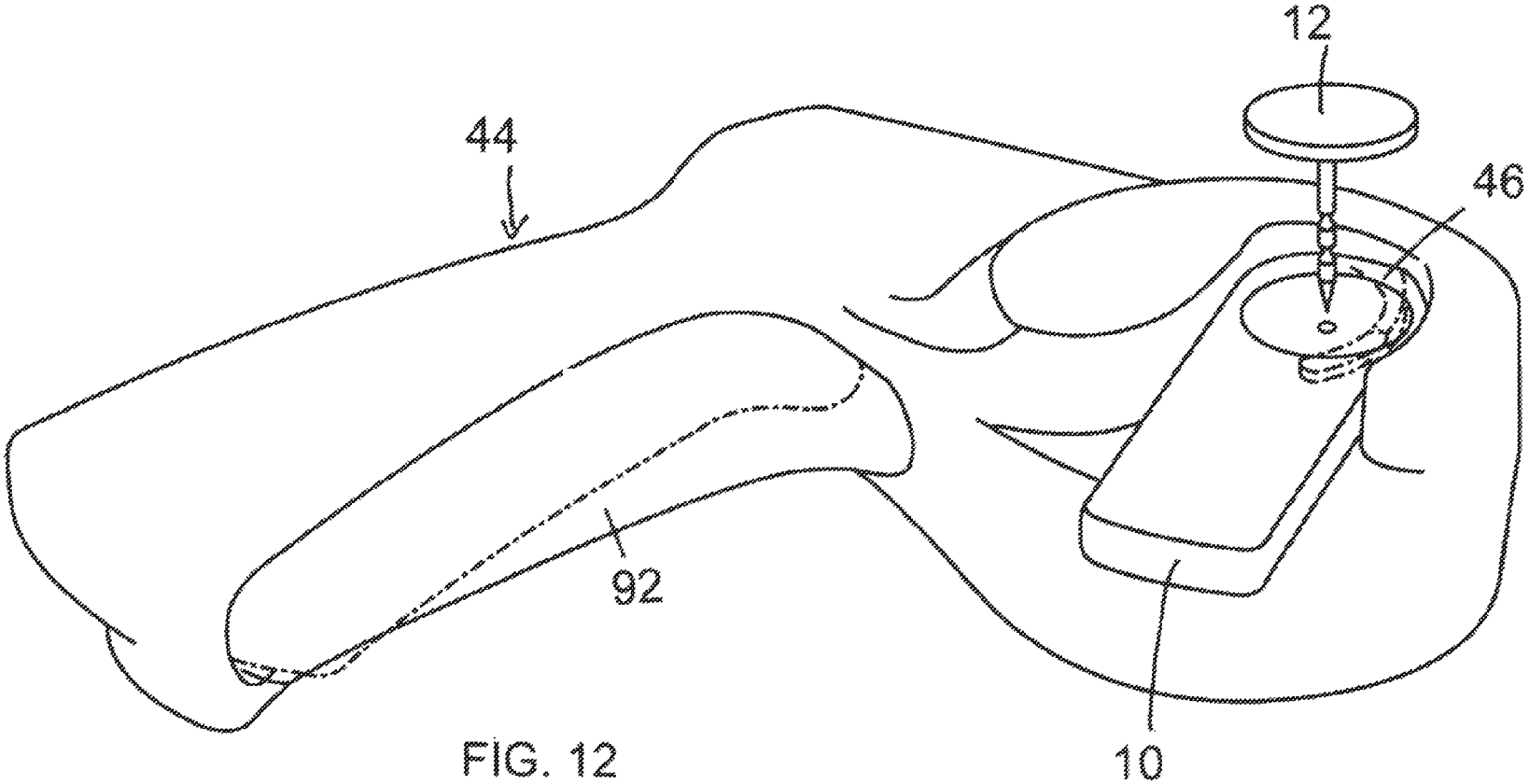
FIG. 12 is a perspective view of the detaching device of FIG. 11 and showing a security device therein.

Spring lock 40 includes a release arm 42 that when pressure is applied will move the spring lock 40 from an engaged position to a released position. An example of a detaching device 16 which will engage spring lock 40 is shown in FIGS. 12 and 13 at 44. The detaching device 44 includes an arcuate arm 46 that engages release arm 42.

An alternate spring lock 18 is shown generally at 50 in FIG. 5. Spring lock 50 is a cross shaped spring lock. The specifics of this lock 50 can be found in U.S. Pat. No. 3,942,829 issued Mar. 9, 1976 to Humble et al. which is incorporated herein by reference. Another example of spring lock 18 is shown generally at 60 in FIG. 6. Spring lock 60 is a more elongate shaped spring lock. The specifics of this lock 60 can be found in U.S. Pat. No. 4,299,870 issued Nov. 1, 1981 to Humble et al. which is incorporated herein by reference.

Figure 7:
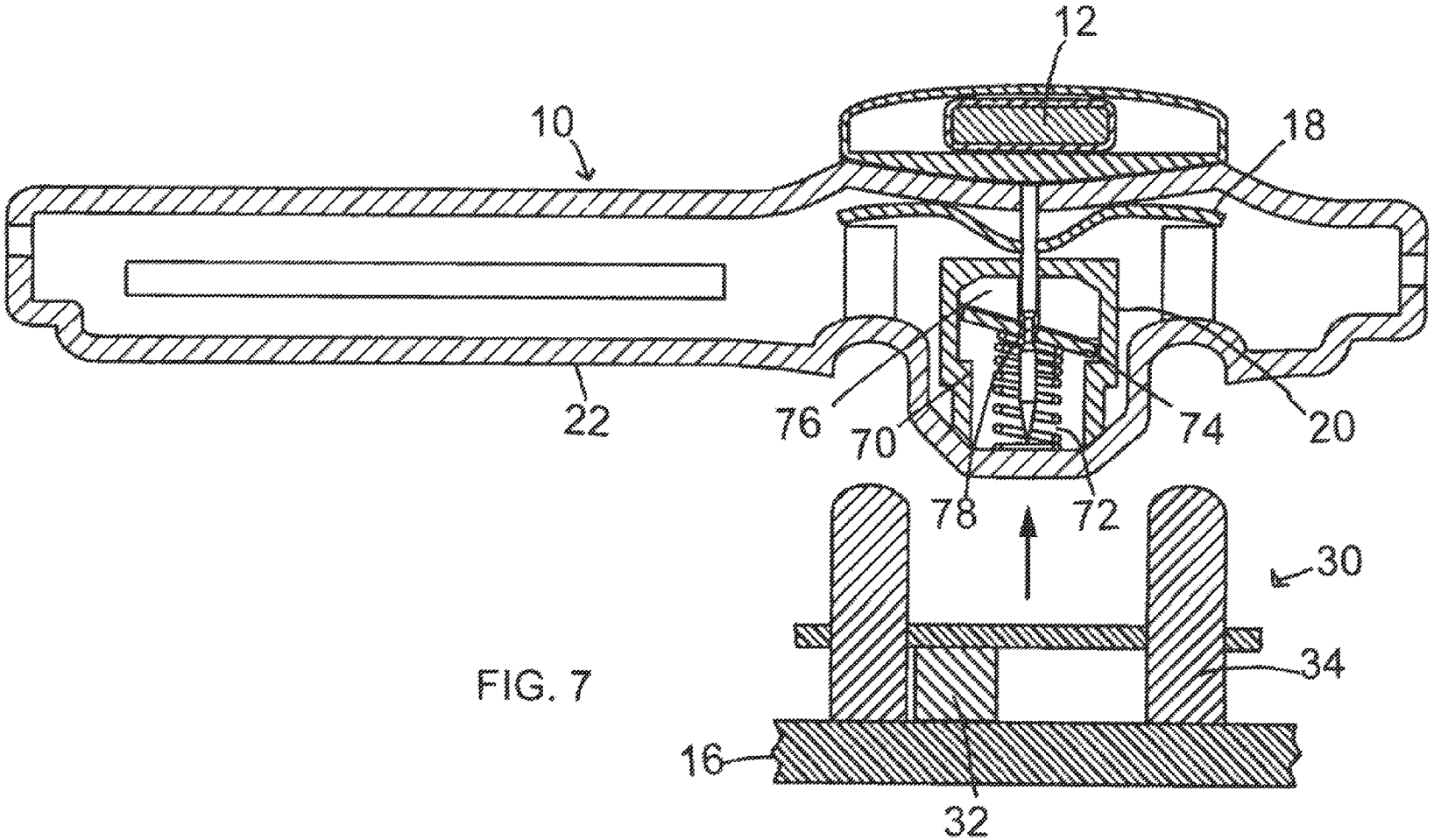
FIG. 7 is a cross sectional view of multi-lock security device and pin and detaching device similar to that shown in FIG. 2 but showing an asymmetric type lock and showing the security device in the locked position.
Figure 8:
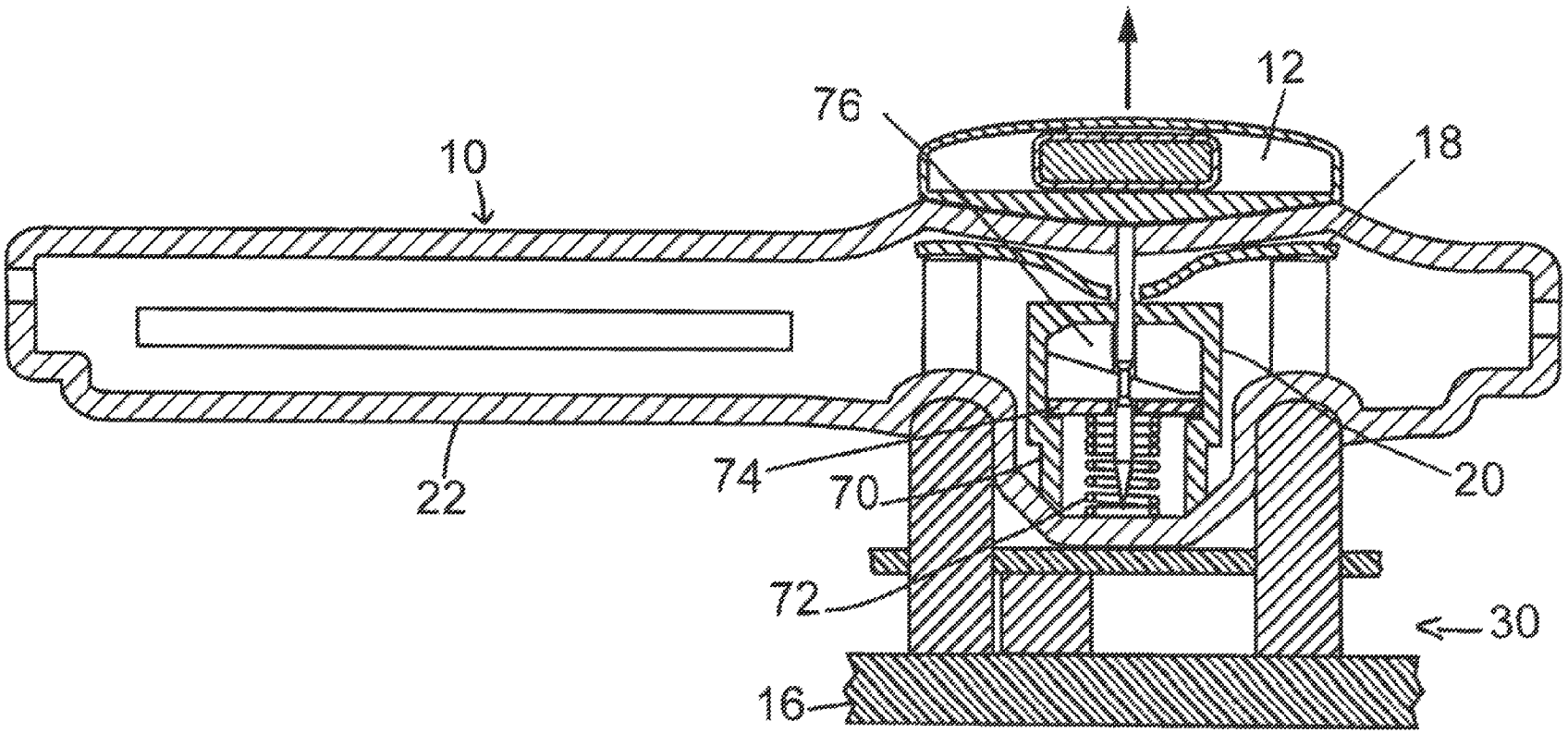
FIG. 8 is a cross sectional view of the multi-lock security device and pin and detaching device as shown in FIG. 7 but showing the security device in the released position.

Referring to FIGS. 7 and 8, as described above security device 10 includes a spring lock 18 and a magnetic lock 20. Magnetic lock 20 is an asymmetric magnetic lock 70. Asymmetric lock 70 includes a spring 72, a washer 74 and an asymmetric seat 76. Washer 74 has an aperture 78 formed therein for receiving pin 12. Washer 74 engages pin 12 when it is in the engaged position as shown in FIG. 7 and releases pin 12 when in the released position shown in FIG. 8. As discussed above spring lock 18 and asymmetric lock 70 are in registration with each other such that they each engage pin 12 when in the engaged position.

The detaching device 16 is similar to that described above with regard to FIG. 3 but with the magnet 32 position such that it releases asymmetric lock 70.

Figure 9:
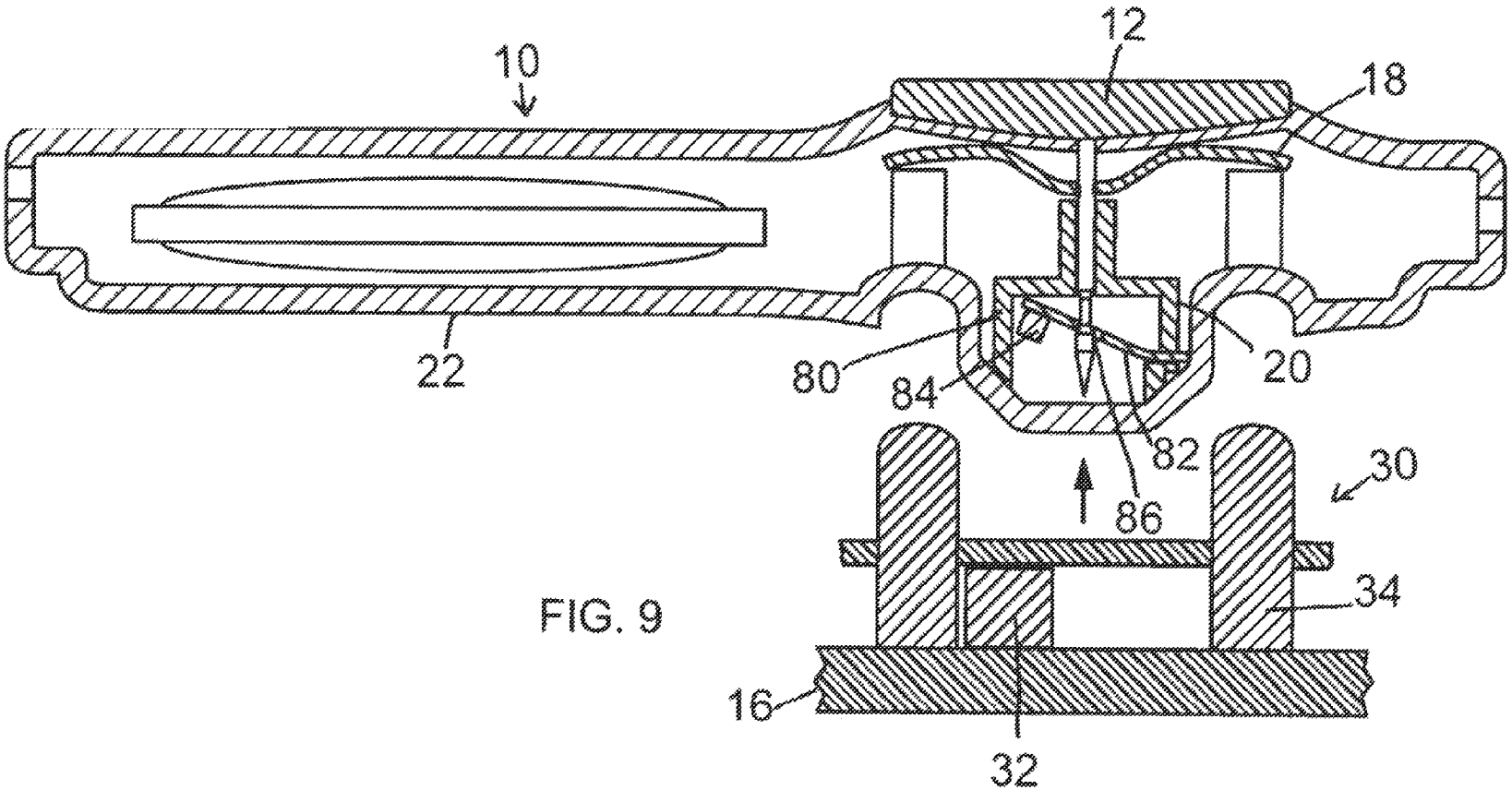
FIG. 9 is a cross sectional view of multi-lock security device and pin and detaching device similar to that shown in FIGS. 2 and 7 but showing a resilient spring plate magnetic type lock and showing the security device in the locked position.
Figure 10:
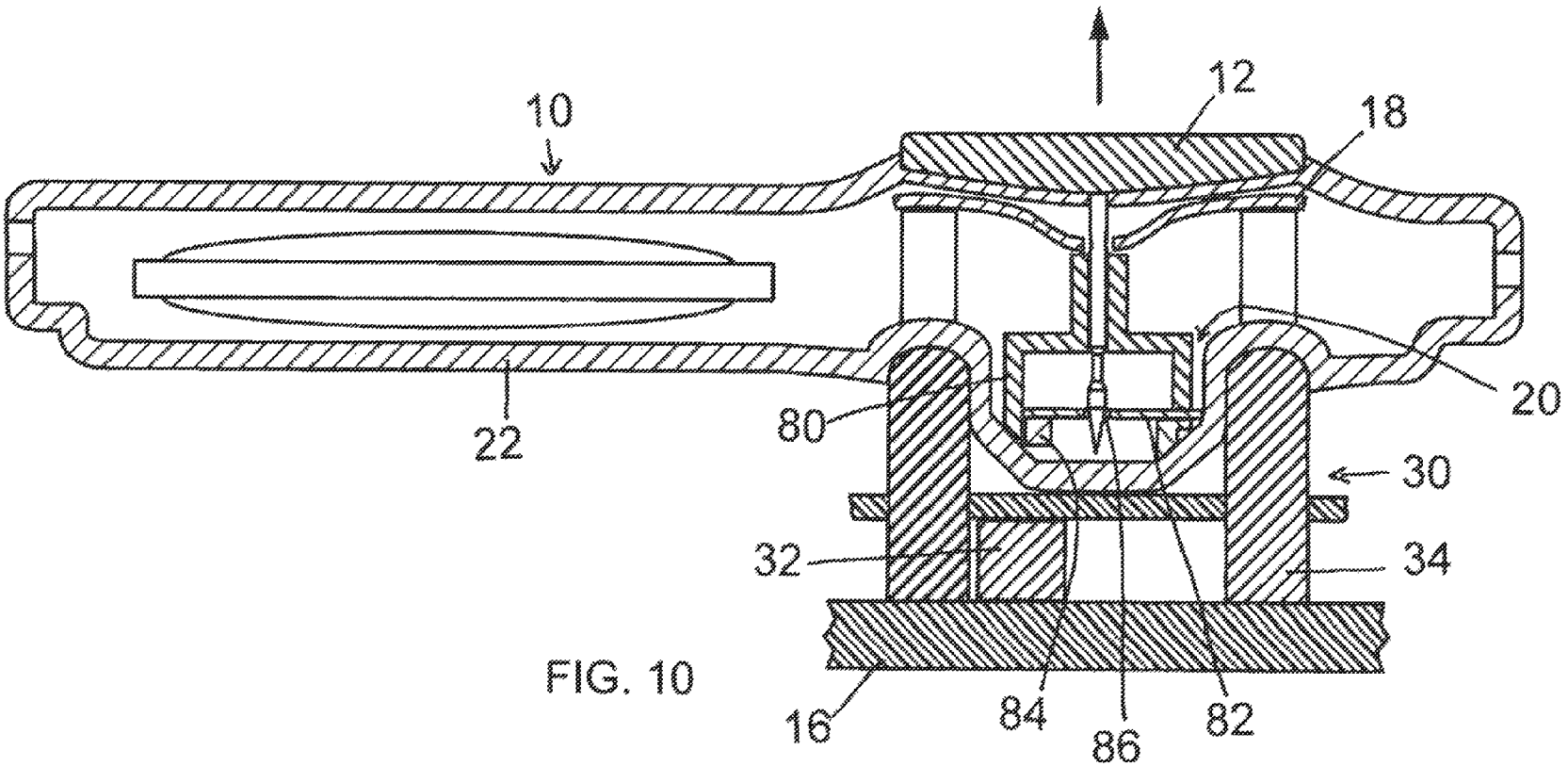
FIG. 10 is a cross section view of multi-lock security device and pin and detaching device as sown in FIG. 9 but showing the security device in the released position.

Referring to FIGS. 9 and 10, as described above security device 10 includes a spring lock 18 and a magnetic lock 20. Magnetic lock 20 is a resilient spring plate magnetic lock 80. The specifics of lock 80 are found in U.S. Pat. No. 4,603,453 issued Aug. 5, 1986 to Yokoyama which is incorporated herein by reference. Lock 80 includes a resilient spring plate 82 with a metal portion 84 and an aperture 86 formed therein. Plate 82 engages pin 12 when it is in the engaged position as shown in FIG. 9 and releases pin 12 when it is in the released position shown in FIG. 10. Metal portion 84 is attracted to magnet 32 when the detaching device 16 is brought into position as shown in FIG. 10 and it moves from the engaged position to the released position.

Figure 11:
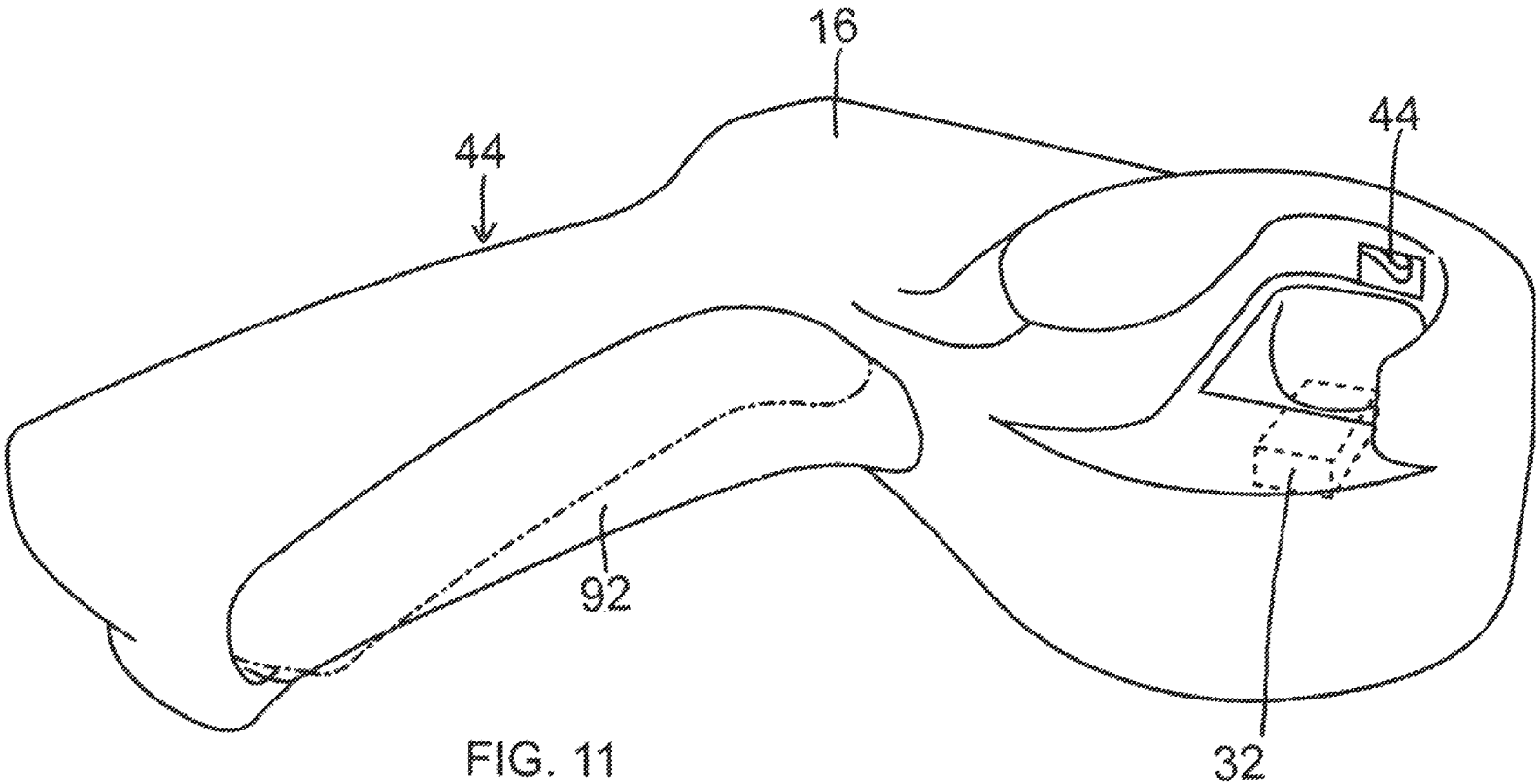
FIG. 11 is a perspective view of the detaching device for use in association with a multi-lock security device and pin wherein the spring lock is that shown in FIG. 4.

FIGS. 11 and 12 show an example 90 of detaching device 16 configured to be used with spring lock 40. Detaching device 90 includes a magnet 32 shown in phantom in FIG. 11. Detaching device 16 includes an arcuate arm 46 that deploys responsive to squeezing trigger 92. As described above arcuate arm 46 engages release arm 42 (shown in FIG. 4). Magnet 32 releases magnetic lock 20.

Typically one of the security device 10 and the pin 12 will also include a sensor 94. As well or in the alternative one of the security device 10 and the pin 12 will include an ink vile 96. Sensor 94 may be an RFID tag, an RF coil, an AM sensor, an electromagnetic sensor or a combination thereof.

Generally speaking, the systems described herein are directed to multi-lock security devices and detaching devices for use therewith. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to multi-lock security devices and detaching devices for use therewith.

As used herein, the terms "comprises" and "comprising" are to construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A security device for use in association with a security pin comprising:

a tag body having a body aperture formed therein adapted to receive the security pin;

at least one sensor;

a first lock within the tag body configured for release by a first detacher, the first lock being a spring lock having a spring lock aperture formed therein in registration with the body aperture and the spring lock being adapted to engage the security pin when in an engaged position and release the security pin when in a released position by the first detacher; and a second lock within the tag body configured for release by a second detacher, the second lock being a magnetic lock having a magnetic lock aperture and the magnetic lock being adapted to engage the security pin when in an engaged position and to release the security pin when in a released position by the second detacher, wherein the second detacher is a magnetic detacher and the spring lock and the magnetic lock need to both be in the released position to successfully remove the security pin from the security device.

2. A security device as claimed in claim 1 wherein the sensor is chosen from the group consisting of an RFID tag, an RF sensor, an AM sensor, an electromagnetic sensor and a combination thereof.

3. A security device as claimed in claim 1 wherein the security device further includes an ink vial.

4. A security device as claimed in claim 1 wherein the magnetic lock is one of a ball clutch type lock, an asymmetric lock and a resilient spring plate magnetic lock.

5. A security device as claimed in claim 1 wherein the spring lock includes a generally rectangular shaped spring.

6. A security device as claimed in claim 1 wherein the spring lock includes a generally cross shaped spring.

* * * * *